US006659556B2

(12) United States Patent
Pellerin

(10) Patent No.: US 6,659,556 B2
(45) Date of Patent: Dec. 9, 2003

(54) RECLINING MOTORIZED MULTI-POSITION CHAIR WITH ROCKING AND PIVOTING ACTION

(76) Inventor: René Pellerin, 290, 170ième avenue, St-Georges de Champlain, Quebec (CA), G9T 3L6

( * ) Notice: Subject to any disclaimer, the term of this patent is extended or adjusted under 35 U.S.C. 154(b) by 0 days.

(21) Appl. No.: 10/155,074

(22) Filed: May 28, 2002

(65) Prior Publication Data

US 2003/0047973 A1 Mar. 13, 2003

(51) Int. Cl.[7] ..... A47C 1/035

(52) U.S. Cl. ..... 297/330; 297/68; 297/84; 297/DIG. 7; 297/DIG. 10; 297/423.28

(58) Field of Search ..... 297/330, 68, 85, 297/84, 89, DIG. 7, DIG. 10, 423.28, 423.3

(56) References Cited

U.S. PATENT DOCUMENTS

| | | | | |
|---|---|---|---|---|
| 3,743,348 A | * | 7/1973 | Sloan | 297/85 |
| 3,756,651 A | * | 9/1973 | Sloan | 297/85 |
| 4,909,569 A | * | 3/1990 | Gaffney | 297/330 |
| 5,061,010 A | * | 10/1991 | LaPointe | 297/330 |
| 5,265,935 A | * | 11/1993 | Geisler et al. | 297/330 |

FOREIGN PATENT DOCUMENTS

| | | | | |
|---|---|---|---|---|
| DE | 3101329 A | * | 9/1982 | A47C/1/03 |

* cited by examiner

*Primary Examiner*—Anthony D. Barfield
(74) *Attorney, Agent, or Firm*—Ogilvy Renault; Guy J. Houle

(57) ABSTRACT

A tilt adjustment assembly for a motorized reclining chair having a base frame adapted for rest on a floor surface. A seat and a back articulated support linkage are interconnected together for displacement of a seat and back of a reclining chair. An intermediate frame is mounted on the base frame through spring attachments, whereby to impart a rocking motion to the chair. A pair of foot rest linkages interconnect each of two of the said seat articulated support linkages to a foot rest plate. The tilt adjustment assembly comprises a motor-operated actuating rod secured at a free end to a sliding member to guidingly displace that member along a straight axis in a fixed plane and to any desired position along the axis. A pivotal link arm is pivotally secured at one end of the sliding member. A transverse linkage securing rod is secured to a second end of the pivotal link arm and extends transversely thereto. The transverse securing rod has opposed ends pivotally connected to an intermediate link arm of a respective one of the pair of foot rest linkages. Tensioning springs are secured to each of the pair of foot rest linkages for applying a restoring force to the foot rest to a retracted position.

15 Claims, 8 Drawing Sheets

Fig. 8
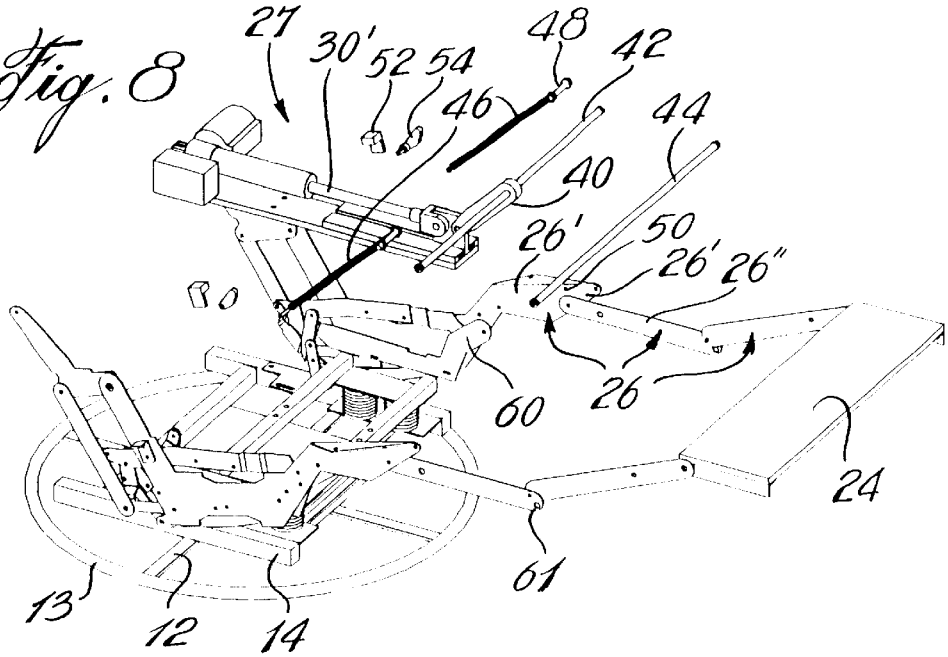
Fig. 9A
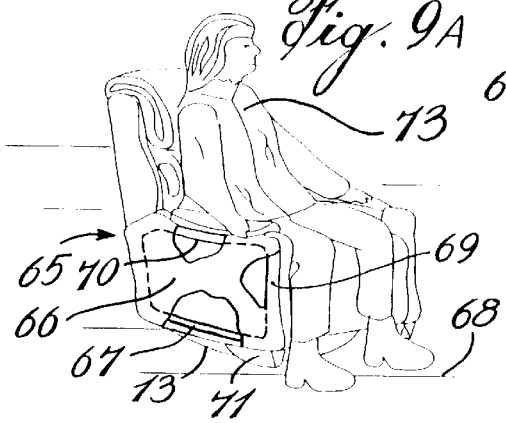
Fig. 10A
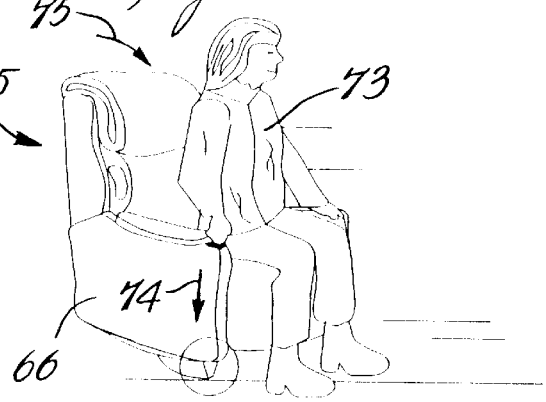
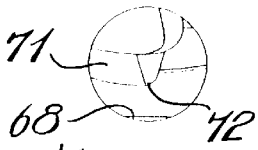
Fig. 9B
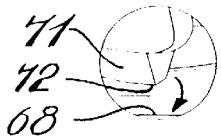
Fig. 10B
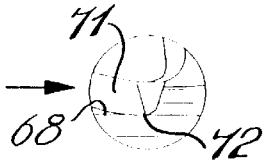
Fig. 10C

RECLINING MOTORIZED MULTI-POSITION CHAIR WITH ROCKING AND PIVOTING ACTION

TECHNICAL FIELD

The present invention relates to the general field of household furniture and is particularly concerned with a motorized, multi-position reclining chair having rocking and pivoting action and other features to permit ease of access for use of such chairs.

BACKGROUND ART

In daily life, chairs are used extensively. Therefore, chairs are typically designed ergonomically to meet the needs of a user's comfort. The requirements for the design of chairs are becoming increasingly stringent with regard to the correct adjustment of the chair. Indeed, the individual adaptation to the user in order to achieve a correct and comfortable sitting position is now considered crucial. This requirement is important since chairs are typically used over a long period time, with the result that an incorrect adjustment feels uncomfortable and leads to potentially harmful sitting positions. It has thus been long recognized that different users generally have different customs and preferences of sitting, and particularly so with older people. Therefore, there is a need for a chair which can be adjusted according to the users' requirements and preferences.

One particularly popular type of chair which can be adjusted to suit the preferences of given individuals is the so-called reclining chair. These chairs are typically provided with a separate linkage mechanism for permitting the seated occupant to selectively actuate an extensible leg rest assembly and/or produce reclining angular movement of a seat assembly between upright and reclined positions. There are numerous linkage arrangements which have been proposed in the prior art for controlling the operation of the reclining mechanism for such chairs, as evidenced both by the extensive patent literature and the numerous commercial chairs which are to be found on the market.

A reclining chair generally takes one of two forms. In a so-called two-way chair, the seat and back are rigidly connected; in moving from the upright position to the fully reclined position, the leg rest rises and the seat and back tilt backwards as a unit. In a three-way chair, the back is pivoted to the seat; in moving from the upright position to the fully reclined position, there is an additional tilt of the back relative to the seat. In both types of chairs, the seat is sometimes made to move forward in reclining positions so that the chair can be placed near a wall even though the seat and back tilting causes the top of the back to move toward the wall; by having the seat move forward, the chair need not be placed several feet from the wall. However, this could provide for an uncomfortable chair.

Moveable leg rests for reclining chairs are also well known in the prior art. A moveable leg rest for reclining chairs may automatically be actuated in response to chair movement or may be hand-actuated to extend between a position of use to a retracted or storage position. In the extended position, the leg rest is disposed generally horizontally relative to the floor level in front of the front edge of the chair. In the retracted position, the leg rest is generally disposed in a vertical position and is usually retracted up against the front edge of the chair beneath the seat.

With the leg rest in the extended position, a user may lean back or recline in a chair and place his or her legs on the leg rest, thereby orienting the legs in an outstretched and generally horizontal position. With the leg rest in the retracted attitude, the user sits in the chair normally with his/her feet on the floor, thereby permitting the chair to be used in the usual fashion since the leg rest is retracted up against the chair behind the chair user's legs.

One common type of leg rest is a type that is supported on the frame of the chair. This type of leg rest is typically actuated by a pantographing linkage type of mechanism between its retracted and extended positions. This type of mechanism includes several linkages which are connected together in scissors fashion to move the foot rest from its relatively vertical position when retracted to a horizontal position when extended and to hold the foot rest in the horizontal position.

This type of actuating mechanism is usually quite complicated, in part because of the requirement that the linkages not only extend the leg rest, but that they also move the leg rest from a vertical to a horizontal position.

Another type of leg rest is one that is supported by the chair seat rather than the frame of the chair. The advantage of this arrangement is that the leg rest and seat relationship stay the same throughout all positions of the seat. However, this type of leg rest also generally uses the complicated pantographing actuating mechanism to extent and retract the leg rest. Furthermore, the actuating mechanism in this type of seat and leg rest arrangement is complicated by the need in many cases to mount the drive means for the actuating mechanism on the chair frame so that the drive means does not move and interfere with other parts of the chair such as upholstery, legs and frame members.

The scissors type of linkage also has other notable disadvantages, foremost amongst which is the safety problem presented by the scissoring action of the linkage itself. Indeed, this scissoring action is capable of causing serious injury such as to a finger or other extremity caught in the mechanism when it is retracted quickly from its extended position. Additionally, the multiplicity of pivot joints in the scissors linkage are all subject to wear and fatigue, often resulting in loosening of the mechanism, with the consequent failure of the foot rest to assume a tightly retracted condition with the chair. Such scissors linkages also have relatively little lateral strength and are subject to easy damage from sideways forces applied to the foot rest when extended. They are also difficult and costly to repair.

Another type of component commonly found, and which selectively locks and unlocks moveable portions to provide a shiftable foot rest, is the so-called Bowden cable assembly which includes a shiftable cable partially received within a tubular jacket. These Bowden cable assemblies are typically coupled with a pivotal handle for shifting the cable between the first and second positions. The handle can be coupled with a rectangular support base which is typically mounted in a chair by cutting a rectangular aperture in a wall of the chair and inserting the rectangular base into the aperture. These types of assemblies are notorious for various drawbacks, including that they cannot be adjusted to various selected positions of comfort because the rectangular aperture precludes any clockwise or counterclockwise rotation of the base with respect to the plane of the wall in which it is retained. Also, the control handle may remain in an awkward extended position after the handle has been manipulated to shift the cable for its primary control purposes due to the resulting friction between the cable and the Bowden jacket.

The hereinabove-mentioned disadvantages associated with conventional mechanically controlled tilt adjustment assemblies are further compounded by the prior art when motorizing such reclining chairs. Although there have been numerous attempts to motorize reclining chair operation, the approach which has generally been taken is to provide a motor to achieve mechanically controlled motion. In other words, one or more motors are added to an existing design in order to aid motion of the several elements, but the physical constraints of the prior art linkages are not overcome. What has been done is to adapt motors to existing designs rather than to recognize that the use of a motor allows new types of motion. In those conventional reclining chairs, or recliners, which do not include special leverage, the motor force is derived by the occupant pushing against the back of the chair. The back starts to move, and the linkage mechanisms in the chair cause the leg rest to rise and the seat to be tilted. Prior art motorized configurations have simply assisted this type of sequencing. The present invention takes into account the fact that the provision of a motor to provide thrust not only allows the use of greatly simplified linkages, but also permits a new type of sequencing to achieve further additional advantages.

Another drawback associated with conventional motorized reclining chairs relates to the fact that the proposed mechanisms often preclude rocking and pivoting of the chair relative to its base. This has proven to be most unacceptable since it greatly deters the overall appeal of such chairs. Furthermore, some motorized prior art chairs only allow for tilting of the chair to a preset and predetermined number of angular relationships between the moveable sections of the chair, and this has been proven to be unacceptable to certain users. Accordingly, there exists a need for an improved tilt adjustment assembly for reclining chairs, which is provided by the present invention.

SUMMARY OF INVENTION

Advantages of the present invention include the fact that the proposed motorized reclining chair and associated tilt adjustment assembly allow greatly simplified linkages to be employed, and further control a sequencing which is far more advantageous than that exhibited by prior art reclining chairs in general and motorized reclining chairs in particular. Furthermore, the proposed tilt adjustment assembly is specifically designed so as to be easily retrofittable to most conventional prior art mechanical reclining chairs. The tilt adjustment assembly allows for continuous angular adjustment over a predetermined range as opposed to the discrete angular adjustment required by prior art designs. The proposed tilt adjustment assembly further increases the range of angular motion afforded by conventional designs. Still further, the proposed tilt adjustment assembly is adapted to maintain a proper tension in the linkage mechanisms so as to prevent undue slacking of the leg rest. This feature can prove to be particularly important since, after a chair has been broken-in through usage, the leg rest could refuse to stay put when fully retracted and adopt a frowning look. Recliner mechanisms generally are constructed to operate smoothly through their motions. When the leg rest suddenly becomes loose, it can be banged against the floor when retracted by the user, giving the user an abrupt change in the feel of the movement, which is discomforting.

Still further, the proposed tilt adjustment assembly of the present invention also allows the chair to rock and pivot about its base. This is believed to be a major advantage over prior art designs. The proposed chair also has auxiliary features such as the optional presence of an auxiliary retractable tray, the optional presence of stabilizing abutment pads and the optional presence of an arm rest design adapted to facilitate extraction and insertion from and to the chair.

Another disadvantage of the prior art recliner chairs or chairs that swivel and rock is that it is sometimes difficult for certain user persons to disembark from the chair due to the fact that the chair is freely tiltable and rotatable. It is, therefore, another feature of the present invention to provide such chairs with a capability of positive engagement with a floor surface when a user person wishes to disembark from the chair.

According to the above advantages of the present invention, from a broad aspect, there is provided a tilt adjustment assembly for a motorized reclining chair having a base frame adapted for rest on a floor surface. A seat and a back articulated support linkage are interconnected together for displacement of the seat and back of a recliner chair, there being one of the said seat and back articulated support linkages on each of opposed sides of the base frame and secured thereabove on a respective linkage support frame. An intermediate frame is mounted on the base frame through spring attachment means to impart a rocking motion to the chair. A pair of foot rest linkages interconnect each of the seat articulated support linkages to a foot rest plate. The tilt adjustment assembly comprises a motor-operated actuating rod secured at a free end to a sliding member to guidingly displace the sliding member along a straight axis in a fixed plane and to any desired position along the axis. A pivotal link arm is pivotally secured at one end to the sliding member. A transverse linkage securing rod is secured to a second end of the pivotal link arm and extends transversely thereto. The transverse securing rod has opposed ends pivotally connected to an intermediate link arm of a respective one of the pair of foot rest linkages. Tensioning means is secured to each of the pair of foot rest linkages for applying a restoring force to the foot rest plate towards a foot rest retracted position.

According to a further broad aspect of the present invention, there is provided a motorized reclining and rocker chair which incorporates the above-described tilt adjustment assembly. The chair has opposed side arms. Each of the side arms has a base elevated from the base frame above a floor surface, a front vertical frame secured to the base, and an arm rest frame secured to the front vertical frame. A floor-engaging leg is secured to the base under the front vertical frame and spaced from a floor surface. The floor-engaging legs engage a floor surface when a user person applies a downward force on the side arm rest forwardly thereof, causing the chair to tilt forward and providing direct lifting support to a user person between the front vertical frame and a floor surface to stabilize the chair and provide positive disembarkation support to the user person.

According to a further broad aspect of the present invention, there is provided a motorized reclining, lifting and tilting rocker chair which incorporates the tilt adjustment assembly. The chair has a lifting and tilting mechanism which is secured to side arms thereof and disposed on opposed outer sides of the seat and back articulated support linkages. Each lifting and tilting mechanism has a displaceable floor-engaging member displaceable from a retracted elevated position, where the chair can recline and rock, and to a lowered floor-engaging position where the chair is arrested from reclining and rocking. A linkage is secured between the floor-engaging member and an associated one of the side arms. A motor-actuated extendible member is secured at one end to a stationary pivot, secured to the floor-engaging member, and at an opposed end to a link pivot connection of the linkage to actuate the displaceable floor-engaging member to firstly cause the floor-engaging member to lower and engage a floor surface and then cause the chair to tilt forwardly.

BRIEF DESCRIPTION OF DRAWINGS

A preferred embodiment of the present invention will now be disclosed, by way of an example thereof, with reference to the following drawings, in which:

FIG. 8 is a partial exploded view, with sections taken out, and illustrating part of the tilt adjustment assembly of the present invention about to be mounted to a conventional tilting chair base, the leg rest part of the chair being shown in an extended configuration;

FIG. 9A is a perspective view of a recliner chair constructed in accordance with the present invention and wherein floor-engaging legs are provided for stability and positive engagement with a floor surface for disembarkation;

FIG. 9B is an exploded view of the leg;

FIG. 10A is a view similar to FIG. 9, showing a person disembarking from the chair;

FIGS. 10B and 10C are exploded views of the leg;

DESCRIPTION OF PREFERRED EMBODIMENTS

Figure 1:
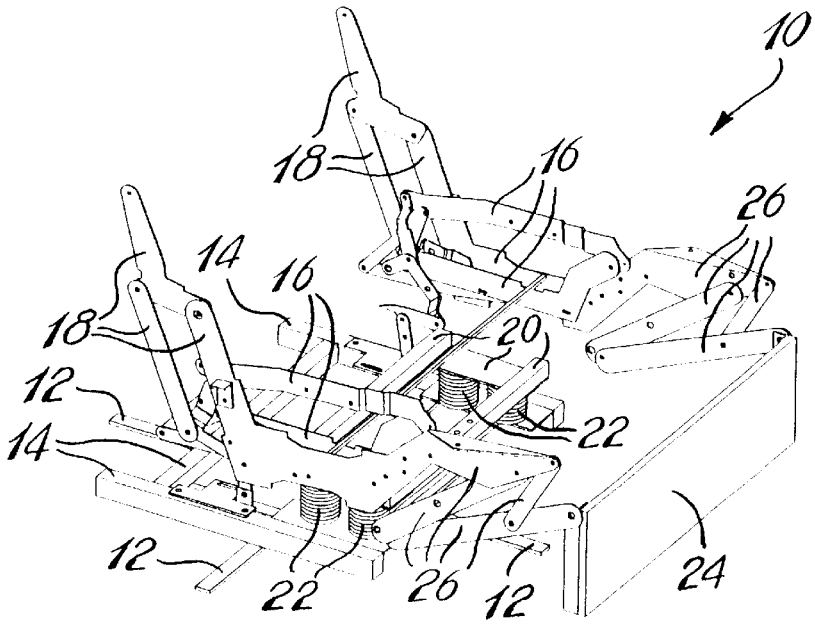
Fig. 1 (PRIOR ART)
FIG. 1 is a perspective view which illustrates a conventional reclining chair base on which the tilt adjustment assembly in accordance with the present invention may be mounted, the chair being shown with its foot rest at a retracted position.
Figure 2:
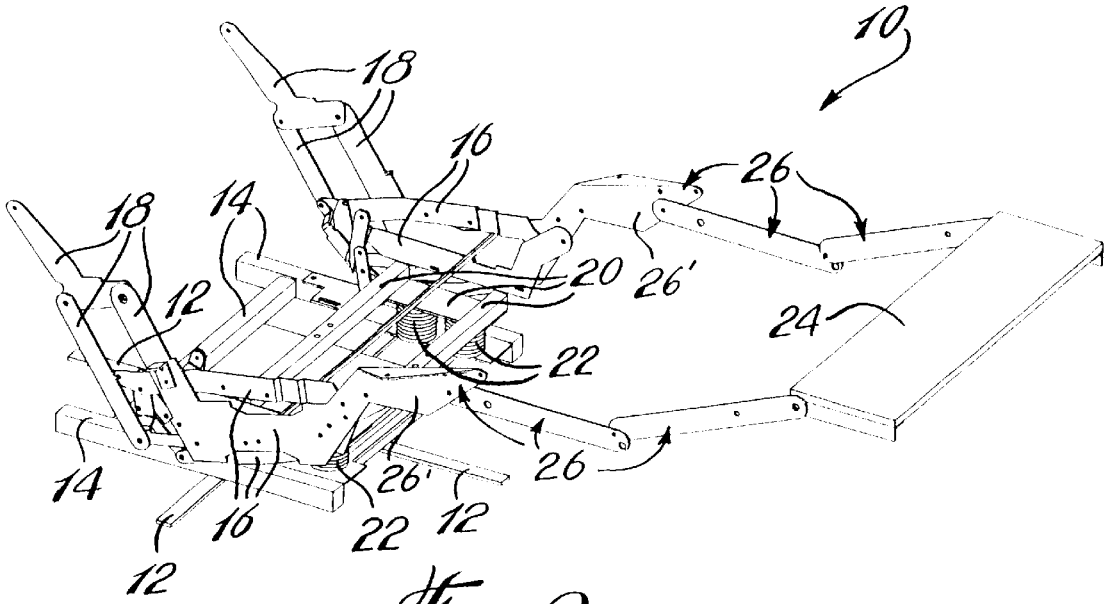
Fig. 2 (PRIOR ART)
FIG. 2 is a perspective view which illustrates a conventional reclining chair base on which a tilt adjustment assembly in accordance with the present invention may be mounted, the chair being shown with its foot rest in an extended position.
Figure 3:
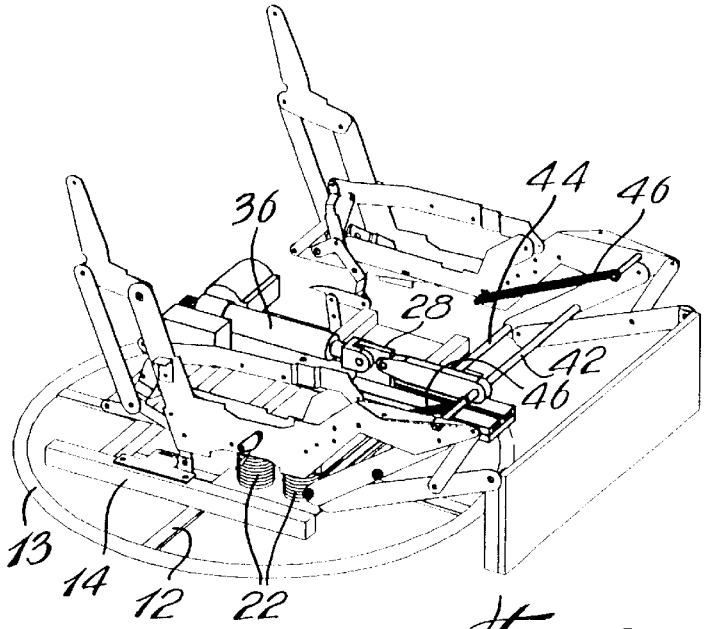
FIG. 3 is a perspective view which illustrates the chair base shown in FIG. 1 incorporating the tilt adjustment assembly of the present invention.
Figure 5:
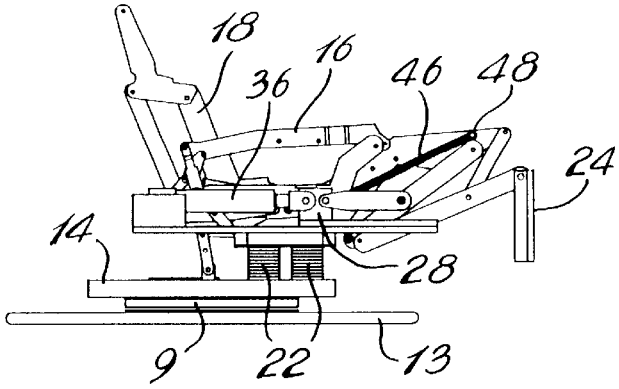
FIG. 5 is a side elevational view of the chair base and tilt adjustment assembly shown in FIG. 3.

Referring to FIGS. 1 and 2, there is shown in the corresponding perspective views a conventional reclining chair linkage mechanism and attachment 10 showing its foot rest respectively at a retracted and extended position. The reclining chair linkage mechanism and attachment 10 includes base legs 12 adapted to rest on a floor surface. A linkage support frame 14 is pivotally and rotatably mounted to the base legs 12, by means well known in the art, such as the rotating guide frame 13 as shown in FIG. 3, so as to allow rocking and pivoting relative motion between the linkage support frame 14 and legs 12. The chair rocks on the springs 22 and swivels on the swivel assembly 9 shown in FIG. 5. Seat and back support linkages 16, 18 are attached to the frame 14 by intermediate frame members 20, preferably through the use of a suspension system such as helicoidal-type springs 22

A foot rest plate 24 is pivotally coupled to the linkage support frame 14 using foot rest linkage arm assembly 26 so as to allow the foot rest plate 24 to pivot between its retracted position shown in FIG. 1 and its extended position shown in FIG. 2. It should be understood that the reclining chair base 10 shown in FIGS. 1 through 8 is only an example of the type of chair frame that can be used with the present invention. Various modifications, including other pantograph linkage configurations, could be used without departing from the scope of the present invention.

Figure 7:
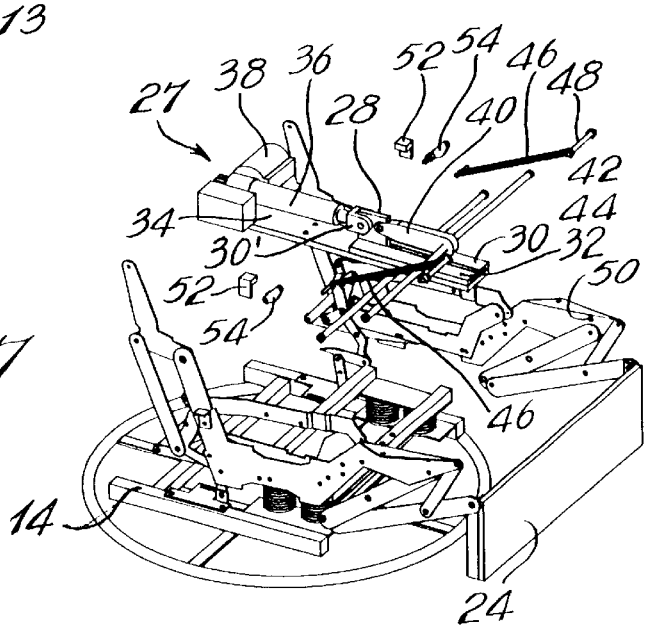
FIG. 7 is a partial exploded view, with sections taken out, and illustrating part of the tilt adjustment assembly of the present invention about to be mounted to a conventional tilting chair base, the leg rest part of the chair being shown in a retracted position.

Referring now more specifically to FIGS. 7 and 8, there are shown some of the components of the tilt adjustment assembly 27 of the present invention. The tilt adjustment assembly includes a sliding skate component 28 mounted within a guiding means for reciprocating action. The guiding means preferably takes the form of a guide plate 30 provided with a longitudinal guiding groove 32 extending therealong. The sliding skate 28 is configured and sized so as to slide within the guiding groove 22.

The guide plate 30 is secured to a mounting plate 34 adjacent to a first longitudinal end thereof. In turn, the mounting plate 34 is adapted to be mechanically coupled to rods of the intermediate frame member 20.

An actuating means for actuating the reciprocating action of the sliding skate 28 is further provided and secured to the mounting plate 34. The actuating means preferably takes the form of a piston cylinder 36 mechanically coupled to a drive motor 38. It is also conceivable that the piston could be replaced by an endless screw drive to axially rotate an endless screw and displace the sliding skate 28.

A lever arm 40 is pivotally coupled to the sliding skate component 38 at a free end thereof opposite its connection with the piston rod 30' of the piston 36 (see FIG. 8). The linkage arm 40 is attached to the skate component 38 so as to allow relative pivotal action therebetween. The linkage arm 40 is adapted to pivot between a retracted position wherein it lies in a generally colinear relationship to the longitudinal axis of the piston 36 and to an extended position wherein it lies in a generally angled relationship relative to the longitudinal axis of the piston 36, as shown in FIG. 8.

Figure 4:
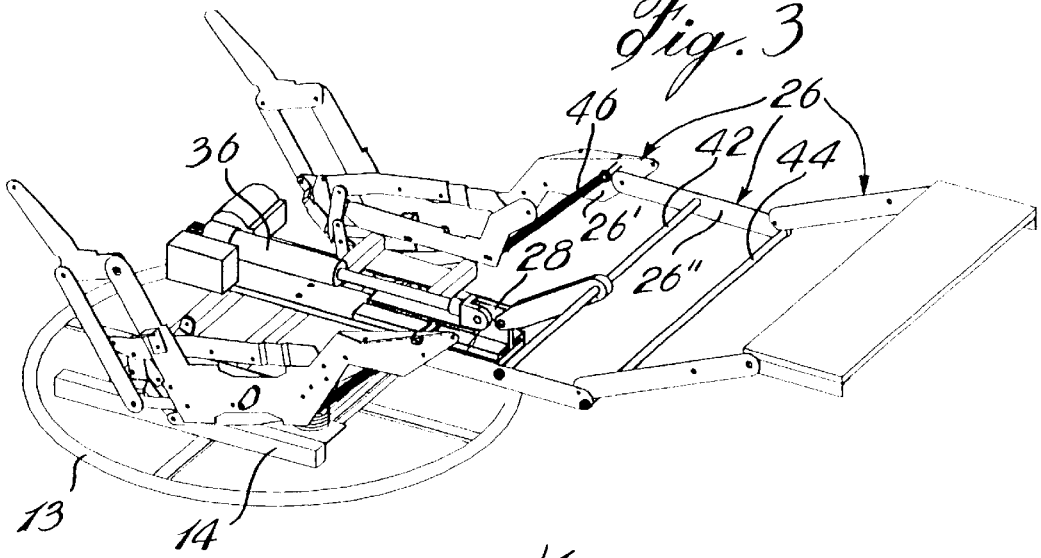
FIG. 4 is a perspective view showing the chair base of FIG. 2 equipped with the tilt adjustment assembly of the present invention.

A first linkage securing rod 42 is solidly secured to the distal end of the lever arm 40 and extends substantially perpendicular relative thereto. A second linkage securing rod 44 is secured to the aperture 61 of the intermediate link arm 26", which is connected to the foot rest plate 24 intermediate the distal segments of the assembly, as shown in FIG. 4.

A tensioning means maintains a predetermined tension in the linkage assemblies 26 during their movement between the retracted and extended positions. The tensioning means preferably takes the form of tensioning helicoidal-type springs 46 attached at a first longitudinal end thereof by attachment bolts 48 to a bolt attachment aperture 50 provided in the leg rest linkage proximal segment 26' and at an opposed longitudinal end thereof to an adjacent linkage segment 60.

Figure 6:
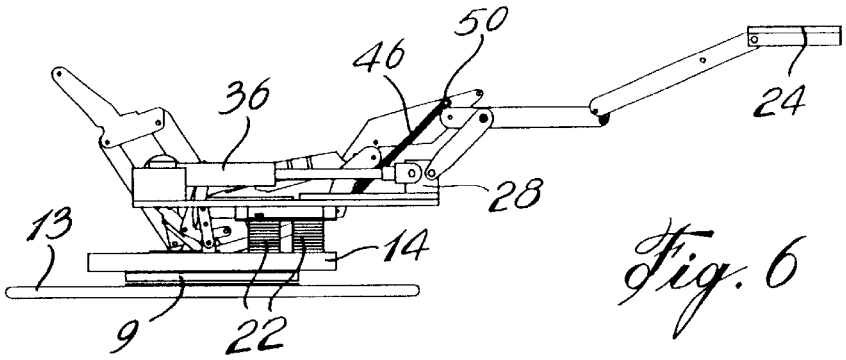
FIG. 6 is a side elevational view of the chair base and tilt adjustment assembly shown in FIG. 4.

The tilt adjustment assembly 27 preferably further includes abutment brackets 52 and anchoring components 54. The anchoring components 54 are adapted to anchor various linkage components of the seat support linkage 16 and coordinate their relative movement therebetween. The brackets 52 prevent rocking movement of the chair when the foot rest linkage arm assembly is extended, as shown in FIG. 6.

In use, a hand-actuable control means, well known in the art, is used for selectively activating the motor 38 and the associated piston cylinder 36. When the cylinder 36 is activated towards its extended position as shown in FIGS. 4, 6 and 8, movement of the skate component 28 attached thereto is transmitted to the lever arm 40 and to the first linkage securing rod 42. The pantograph configuration of the leg rest linkage arms 26 causes the latter to extend to its extended position, allowing the foot rest plate 24 to move to its substantially horizontal position. The second linkage securing rod 44 allows for coordination of the deployment of the foot rest linkage arms 26 and ensures stability of the mechanism.

As mentioned previously, the tilt adjustment assembly allows an intended user to position the foot rest plate 24 at any intermediate position between the retracted and extended configurations by controlling the motor, and therefore the extension of the piston rod 30', and consequently the position of the skate component 28 on the guide plate 30 and thus the angular position of the foot rest linkage arm assembly 26. Once the skate component 38 has reached a position substantially midway between its longitudinal end points, the pantograph configurations of the linkages 16 and 18 allow for the reclining of the back rest section of the seat. When the tilt adjustment assembly is in the retracted position, shown in FIG. 5, the proposed mechanism allows for full tilting and pivotal action of the seat relative to its base while the assembly is in its extended configuration, as shown in FIG. 6. The rocking movement is temporarily prevented by the abutment brackets 52 which abut on the frame members 20 so as to increase stability of the overall seat.

With reference now to FIGS. 9 and 10, there is shown generally at 65 a motorized reclining and rocker chair incorporating the tilt adjustment assembly 27 of the present invention, but not shown in these illustrations. The reclining and rocker chair 65 has opposed side arms 66. Each of these side arms has a base 67 elevated from the base frame 13 above the floor surface 68. The side arms also have a front vertical frame 69 secured to the base 67, and an arm rest frame 70 which is secured to the front vertical frame 69.

The improvement resides in that a floor-engaging leg 71 is secured to the base frame 67 under the front vertical frame 69 and has a lower edge 72 spaced from the floor surface 68. This lower edge 72 engages the floor surface 68 when the user person 73 applies a downward force on the arm rests in the direction of arrow 74, as shown in FIG. 10, and forwardly of the arm rest to cause the chair to tilt forward in the direction of arrow 75, and providing direct connection with the floor surface 68 to stabilize the chair and provide positive disembarkation support to the user person 73. Accordingly, this prevents the chair from swiveling sideways or tilting, which could cause injury to a frail or aged person.

Figure 15A:
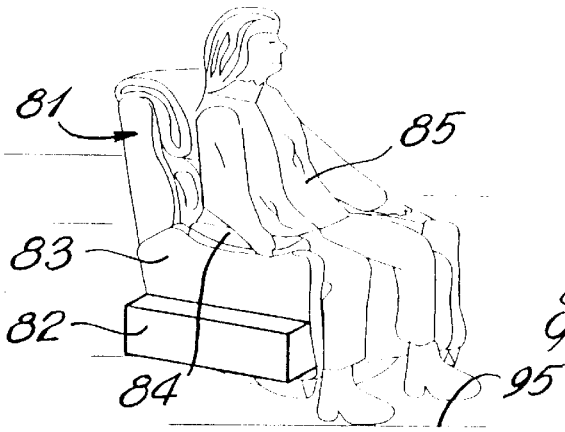
FIGS. 15A to 15C are simplified perspective views showing a person sitting in the motorized reclining and rocker chair with the lifting and tilting mechanism actuated to position the chair to an occupant disembarking or embarking position.
Figure 15B:
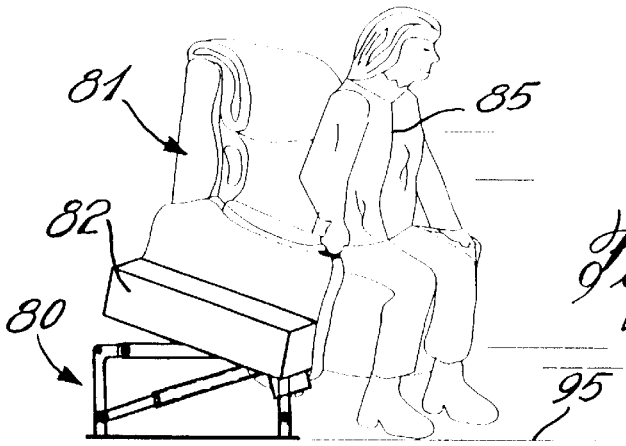
Figure 15C:
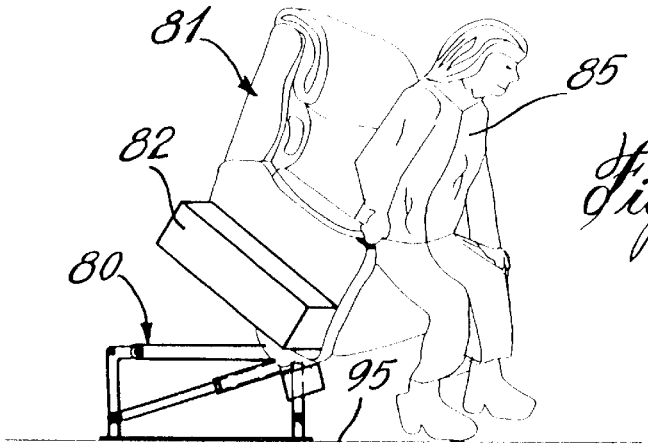

Referring now to FIGS. 11A to 11D, there is shown generally at 80 the chair lifting and tilting mechanism. As herein shown, the mechanism is secured to opposed sides of the chair frame below the side arms. This is better illustrated in FIG. 15A, wherein the chair 81 is provided with an enclosure 82 on the side arm frame 83 and space below the side arms 84. The enclosure 82 conceals the lifting and tilting mechanism 80, as can be seen from FIGS. 15B and 15C. When the lifting and tilting mechanism is actuated by the occupant 85 of the chair, the lifting and tilting mechanism 80 causes the chair to rise and tilt forward, as shown in FIGS. 15B and 15C, whereby the occupant 85 is disposed at a substantially vertical position to make it easy for the occupant to disembark or to embark the chair. The mechanism 80 is actuated by a switch accessible to the occupant and not illustrated herein, but obvious to a person skilled in the art.

With additional reference now to FIGS. 12 to 14C, there will be described the construction and operation of the lifting and tilting mechanism 80. As herein shown, the mechanism is disposed on opposed outer sides of the seat and back articulated support linkages 16 and 18, as shown in FIGS. 1 and 2. Seeing that the lifting and tilting mechanisms secured on opposed sides of the chair are identical, only one will be described herein.

Figure 11A:
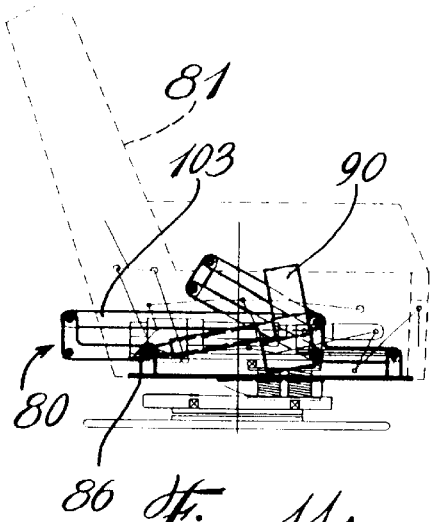
FIGS. 11A to 11D are side views showing the construction operation of a lifting and tilting mechanism secured to the side arms of the reclining rocker chair.
Figure 11B:
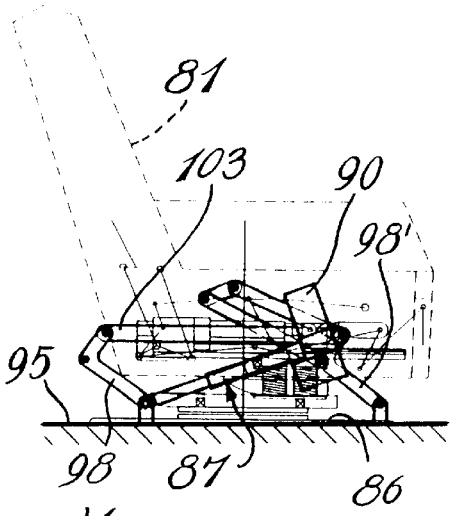
Figure 11C:
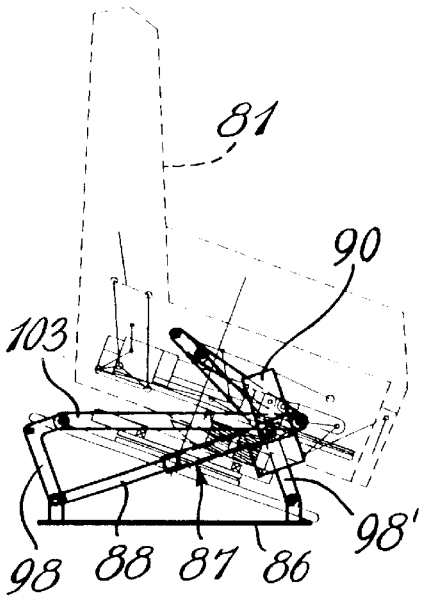

The lifting and tilting mechanism has a displaceable floor-engaging member 86 which is essentially a longitudinal flat narrow metal plate. This plate is displaceable by the linkage from a retracted elevated position, as shown in FIG. 11A, where the chair can recline and rock, and to a lowered floor-engaging position, as shown in FIG. 11B, where the chair is arrested from reclining and rocking due to the interconnection of the chair with the floor through the linkage 80.

As better shown in FIGS. 12 to 14C, the lifting and tilting mechanism is provided with a motor-actuated extendible member 87, which consists essentially of a threaded rod 88 which is threadably engaged in a rotatable cylinder 89. The cylinder 89 is connected to an electric motor 90 through a gear coupling located in a gear box 91. The electric motor 90 has a gear secured to a driveshaft thereof whereby to cause relative rotation between the cylinder 89 and the threaded rod 88, whereby to cause the combination of the cylinder and rod to expand and retract to actuate the linkage and displace the chair. The extendible member 87 is pivotally secured at one end to a stationary pivot 92, which is secured to a post 93 connected to the floor-engaging member 86. The opposed end of the motor-actuated extendible member 87 is pivotally secured to a link pivot connection 94 of the linkage 80 to actuate the displaceable floor-engaging member 86 to firstly cause it to lower and engage a floor surface 95, as shown in FIG. 11B, and then cause the chair 81 to tilt forwardly, as shown in FIG. 15C.

The linkage of the lifting and tilting mechanism 80 comprises an attaching link arm 96 having a pivot connection 97 and 97' at opposed ends thereof. These pivot connections 97 and 97' are secured to fixed pivot points of the side frames of the chair. The linkage also comprises a pair of right-angled tandem arms 98 and 98' pivotally secured at one end 99 and 99' to a respective one of the pivot posts 93 and 93'. The pivot post 93' is disposed at the forward end of the chair, whereas the post 93 is at a rear end thereof.

Figure 14A:
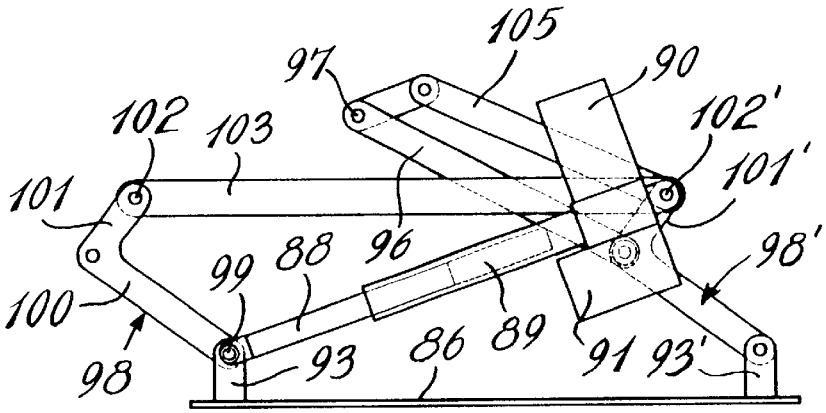
FIGS. 14A to 14C are side views showing the lifting and tilting mechanism of FIG. 12 at various positions of its full actuated cycle.
Figure 14B:
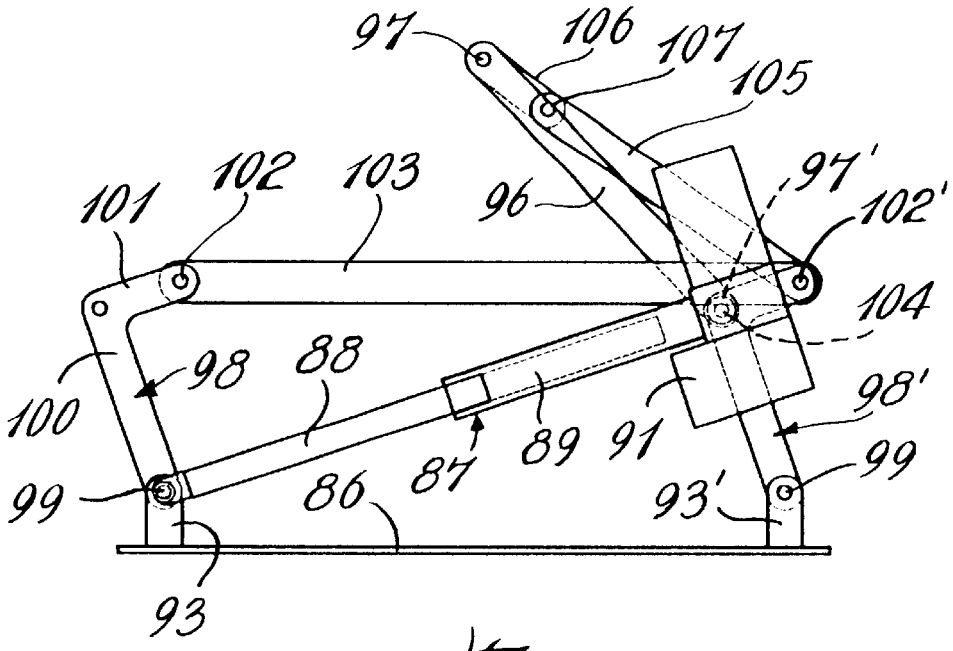
Figure 14C:
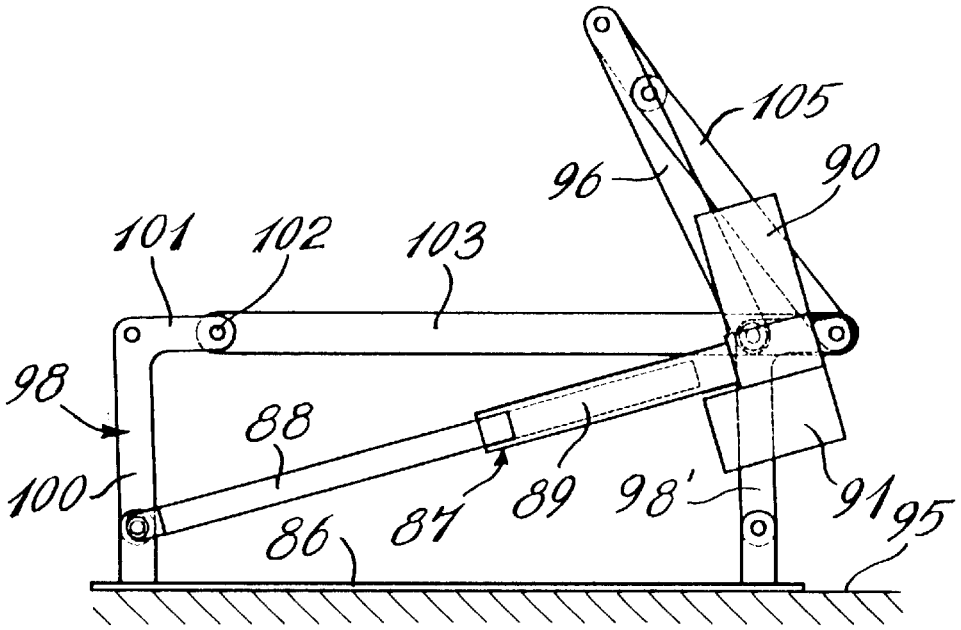

As can be seen more clearly from FIGS. 14A to 14C, each of the tandem arms is an L-shaped arm and defines an elongated arm section 100 and a transverse right-angled elbow end section 101. The elbow end sections 101 are pivotally interconnected together at a pivot connection 102 and 102', disposed at a free end thereof, by a longitudinal interconnecting link arm 103. The forward one of the tandem arms, namely arm 98', has a pivot connection 104 with the forward one 97' of the fixed pivot points of the attaching link arm 96. This pivot connection 104 is disposed at the intersection 105 of the transverse elbow end section 101 and the straight arm section 100, as better seen in FIG. 12. The forward one of the tandem arms, namely arm 98', is pivotally interconnected at the forward end 102' to a rearward one of the fixed pivots, namely pivot 97, by a set of articulated pulling link arms, namely a long pulling link arm 105 and a shorter pulling link arm 106, which are interconnected together by a pivot connection 107. FIGS. 12 and 14A to 14C illustrate the displacement of these articulated pulling link arms as the extendible member 87 is displaced to its fully extended position.

Figure 11D:
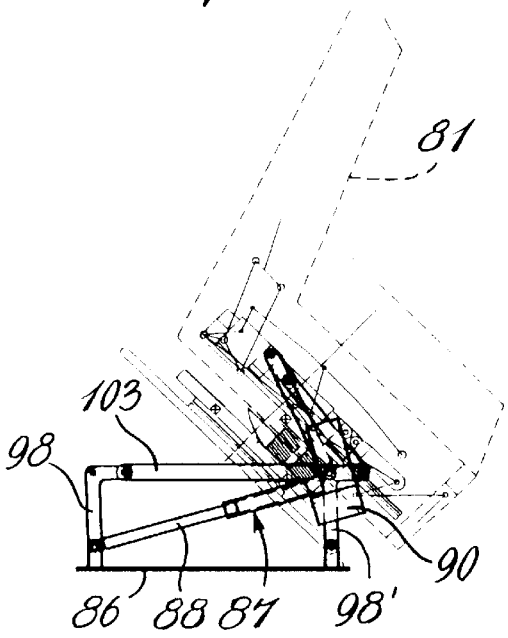
Figure 12:
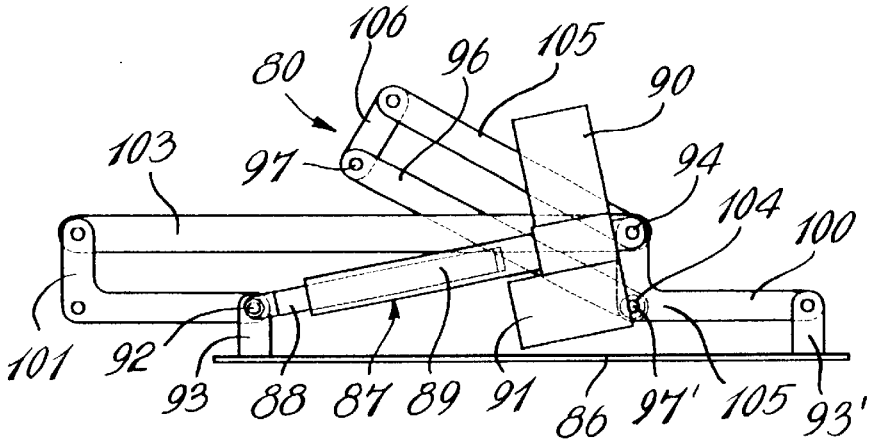
FIG. 12 is a side view of the lifting and tilting mechanism.
Figure 13A:
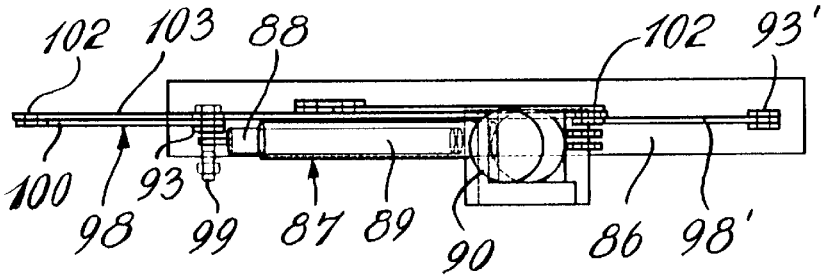
FIG. 13A is a top view of the lifting and tilting mechanism.
Figure 13B:
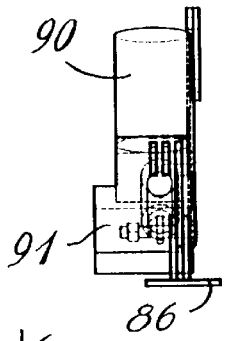
FIG. 13B is a front view of the lifting and tilting mechanism.

As better illustrated in FIGS. 14C and 11D, the longitudinal interconnecting link arm 103, the tandem arms 98 and 98', and the floor-engaging member 86 form a rectangular chair support frame that is disposed on the floor surface 95 when the chair is at a full lifted and forwardly tilted position, as shown in FIG. 15C. This rectangular chair support frame configuration adds rigidity to the entire structure and chair. Also, the extendible member 87 is disposed substantially diagonally across the rectangular chair support frame, forming somewhat a crosspiece whereby to strengthen the frame when in that position.

Although not shown, a single motor 90 may be utilized to actuate both the right and left side lifting and tilting mechanisms 80 by having a drive rod extending under the chair and actuated by the gear train provided in the gear box 91, and coupled to the extendible member 87 on the other side.

It is within the ambit of the present invention to provide any obvious modifications of the preferred embodiments described herein, provided such modifications fall within the scope of the appended claims.

What is claimed is:

1. A tilt adjustment assembly for a motorized reclining chair having a base frame adapted for rest on a floor surface, a seat and a back articulated support linkage interconnected together for displacement of a seat and back of a reclining chair, there being one of said seat and back articulated support linkages on each of opposed sides of said base frame and secured thereabove on a respective linkage support frame, an intermediate frame mounted on said base frame through spring attachment means to impart a rocking motion to said chair, and a pair of foot rest linkages interconnecting each of said seat articulated support linkages to a foot rest plate, said tilt adjustment assembly comprising a motor-operated actuating rod secured at a free end to a sliding member to guidingly displace said sliding member along a straight axis in a fixed plane and to any desired position along said axis, a pivotal link arm pivotally secured at one end to said sliding member, a transverse linkage securing rod secured to a second end of said pivotal link arm and extending transversely thereto, said transverse securing rod having opposed ends pivotally connected to an intermediate link arm of a respective one of said pair of foot rest linkages, and tensioning means secured to each of said pair of foot rest linkages for applying a restoring force to said foot rest plate towards a foot rest retracted position.

2. A tilt adjustment assembly for a motorized reclining chair as claimed in claim 1, wherein said motor-operated actuating rod is a piston rod of a piston cylinder, said straight axis lying substantially midway between said pair of foot rest linkages.

3. A tilt adjustment assembly for a motorized reclining chair as claimed in claim 2, wherein said sliding member is a slide skate held captive in a guide plate and displaceable along a straight slot of said guide plate, said straight slot constituting said straight axis.

4. A tilt adjustment assembly for a motorized reclining chair as claimed in claim 3, wherein said piston cylinder and a motor for operating the displacement of said piston rod are secured to a mounting plate connected to said intermediate frame, said guide plate being secured to said mounting plate.

5. A tilt adjustment assembly for a motorized reclining chair as claimed in claim 4, wherein said foot rest linkages comprise three intermediate link arms, said transverse securing rod being pivotally connected to an intermediate one of said three link arms, and wherein there is further provided a second linkage securing rod pivotally secured at opposed ends thereof to a respective one of said intermediate link arms at an end thereof where a first forward link arm is connected, said foot rest being secured between said first forward link arms, a third of said link arms being pivotally connected to each of said seat articulated support linkages.

6. A tilt adjustment assembly for a motorized reclining chair as claimed in claim 1, wherein said spring attachment means is comprised by elongated helical springs secured between said intermediate frame and said base frame.

7. A tilt adjustment assembly for a motorized reclining chair as claimed in claim 1, wherein said base frame includes a rotating guide frame whereby a reclining chair may be rotated to a desired position by a user person.

8. A tilt adjustment assembly for a motorized reclining chair as claimed in claim 1, wherein there is further provided abutment means secured to said seat support linkage to prevent rocking movement of said chair when said foot rest plate is disposed at a retracted, substantially vertical position.

9. A motorized reclining and rocker chair incorporating the tilt adjustment assembly of claim 1, said chair having opposed side arms; each said side arm having a base member elevated from said base frame above a floor surface, said chair having a front vertical member secured to said base member, and an arm rest member secured to said front vertical member; a floor-engaging leg is secured to said base member under said front vertical member and has a lower edge spaced from a floor surface, said floor-engaging legs engaging a floor surface when a user person applies a downward force on said arm rests forwardly thereof causing said chair to tilt forward whereby said legs provide direct lifting support to a user person between said front vertical member and a floor surface whereby to stabilize said chair and provide positive disembarkation support to said user person.

10. A motorized reclining and rocker chair as claimed in claim 9, wherein said floor-engaging legs each have a curved lower edge curving rearwardly upwards towards said base.

11. A motorized reclining, lifting and tilting rocker chair incorporating the tilt adjustment assembly of claim 1, said chair having a lifting and tilting mechanism secured to said chair below said side arms thereof and disposed on opposed outer sides of said seat and back articulated support linkages, each said lifting and tilting mechanism having a displaceable floor-engaging member displaceable from a retracted elevated position, where said chair can recline and rock, and to a lowered floor-engaging position where said chair is arrested from reclining and rocking; a linkage secured between said floor-engaging member and an associated one of said side arms, a motor-actuated extendible member secured at one end to a stationary pivot, secured to said floor-engaging member, and at an opposed end to a link pivot connection of said linkage to actuate said displaceable floor-engaging member to firstly cause said floor-engaging member to lower and engage a floor surface and then cause said chair to tilt forwardly.

12. A motorized reclining, lifting and tilting rocker chair as claimed in claim 11, wherein said extendible member is a threaded rod threadably engaged in a cylinder, and a motor having a gear secured to a driveshaft thereof to cause relative rotation between said threaded rod and said cylinder to cause extension and retraction movement therebetween to actuate said linkage.

13. A motorized reclining, lifting and tilting rocker chair as claimed in claim 12, wherein said linkage comprises an attaching link arm having a pivot connection at opposed ends thereof secured to said side arm at fixed pivot points, a pair of right-angled tandem arms pivotally secured at one end to a respective pivot post adjacent to a front and rear end of said floor-engaging member, each said tandem arm being L-shaped to define a transverse elbow end section, said elbow end sections being pivotally interconnected together at a forward end by a longitudinal interconnecting link arm, a forward one of said tandem arms having a pivot connection with a forward one of said fixed pivot points of one of said attaching link arms at an intersection of said transverse elbow end section and a straight arm section thereof, said forward one of said tandem arms being pivotally interconnected at said forward end to a rearward one of said fixed pivot points of said one of said attaching link arms by a set of articulate pulling link arms.

14. A motorized reclining, lifting and tilting rocker chair as claimed in claim 13 wherein said tandem arms, said longitudinal interconnecting link arm and said floor-engaging member form a rectangular chair support frame on a floor surface when said chair is at a full lifted and forwardly tilted position.

15. A motorized reclining, lifting and tilting rocker chair as claimed in claim 14, wherein said extendible member is disposed substantially diagonally across said rectangular chair support frame to strengthen said frame when in that position.

* * * * *